US005303915A

United States Patent [19]

Candy

[11] Patent Number: 5,303,915

[45] Date of Patent: Apr. 19, 1994

[54] TENNIS BALL TO LINE LOCATION

[75] Inventor: Bruce H. Candy, Basket Range, Australia

[73] Assignee: Caldone Pty Limited, Camden Park, Australia

[21] Appl. No.: 960,368

[22] PCT Filed: Jun. 27, 1991

[86] PCT No.: PCT/AU91/00278

§ 371 Date: Dec. 24, 1992

§ 102(e) Date: Dec. 24, 1992

[87] PCT Pub. No.: WO92/00125

PCT Pub. Date: Jan. 9, 1992

[30] Foreign Application Priority Data

Jun. 27, 1990 [AU] Australia ..... PK0830

[51] Int. Cl.[5] ..... A63B 61/00; A63B 71/06

[52] U.S. Cl. ..... 273/31; 340/323 R

[58] Field of Search ..... 273/31; 340/323 R

[56] References Cited

U.S. PATENT DOCUMENTS 3,774,194 11/1973 Jokay et al. ..... 273/31 X
3,883,860 5/1975 von Kohorn ..... 273/31 X
4,092,634 5/1978 von Kohorn ..... 273/31 X

FOREIGN PATENT DOCUMENTS 3712293 10/1987 Fed. Rep. of Germany .

OTHER PUBLICATIONS

WO 89/00066, Candy, "Ball Location System" Jan. 1989.

WO 83/01904, Gray, "Line Fault Detector", Jun. 1983.

*Primary Examiner*—William H. Grieb

*Attorney, Agent, or Firm*—Cushman, Darby & Cushman

[57] ABSTRACT

A means and arrangement to assist in determining the location of a ball relative to a line of a game surface is disclosed. The arrangement utilizes transmit and receive coils buried beneath lines on a game surface. Overlapping transmit coils operate at different frequencies and include filtering means to make each transmit coil substantially independent of the other transmit coil.

31 Claims, 6 Drawing Sheets

Figure 1:
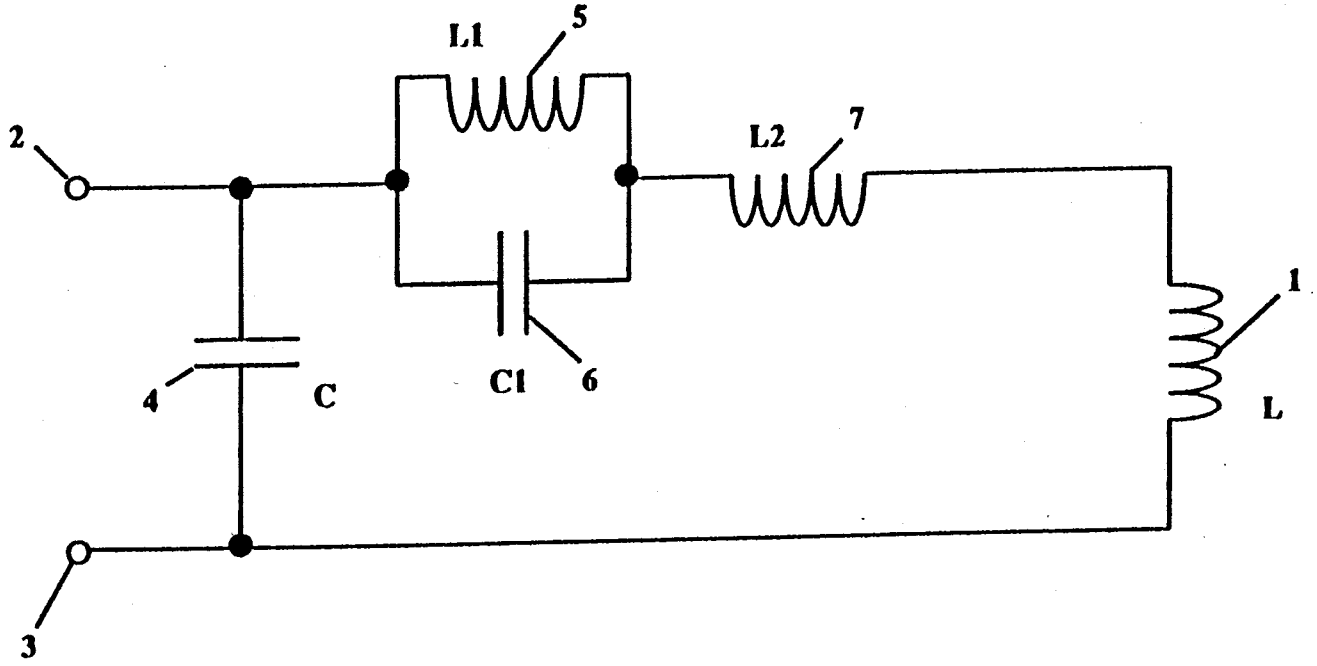

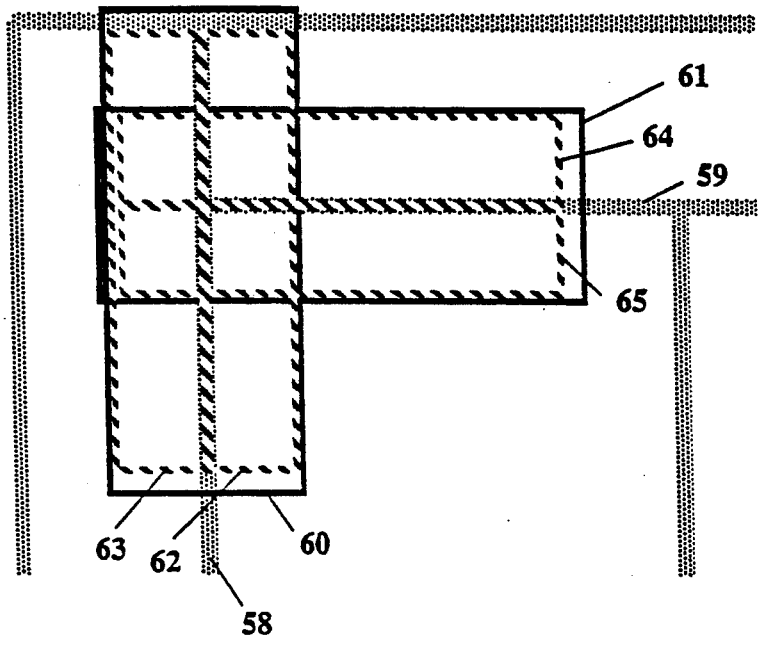
Figure 6(b)
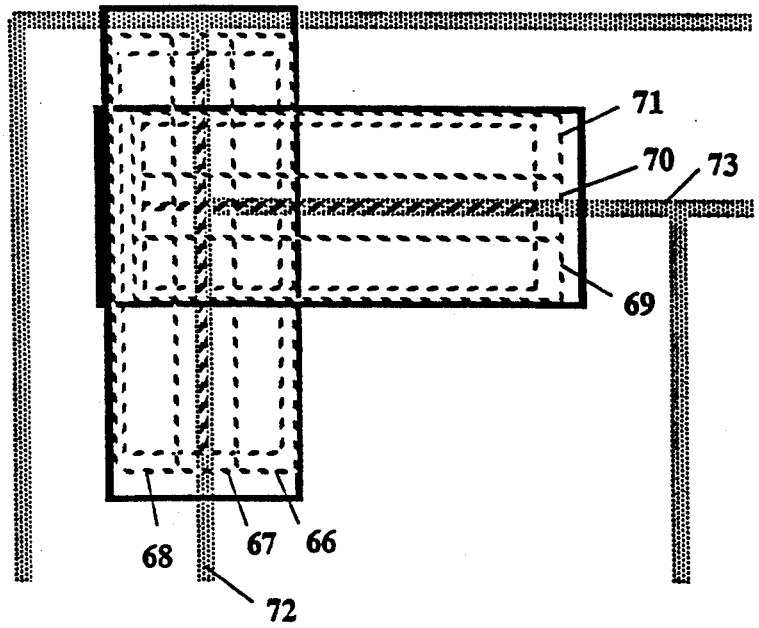

TENNIS BALL TO LINE LOCATION

This invention relates to a means and method for locating the position of a ball relative to a line on a game surface. In particular the invention relates to a means and method for locating the position of a tennis ball relative to a line on a tennis court.

It will be appreciated that whilst the invention disclosed herein is applicable to the game of tennis it can be applied to other games using lines to mark a playing surface and a ball that can be manufactured with permeable material. It will be understood herein that the term "magnetically permeable" material refer to a material with substantially larger permeability than the magnetic constant ($4\pi \times 10^{-7}$ T.m/A). The discussion that follows will refer to the game of tennis as a means to illustrate the invention.

Previous patent specification PCT/AU88/00229 describes an arrangement in which a transmit loop or coil beneath and aligned with the line and is adapted to transmit an alternating magnetic field. A receiver loop or coil is located so that perturbations to the field resulting from magnetically permeable objects moving within the influence of the field are detected by the receiver coil. The receiver coil is connected to detection electronics.

It will be understood herein that a receive coil is connected to a relatively high impedance load. The effect of this is that the receiver coil substantially does not affect the electromagnetic field generated by current flowing through the transmit coil.

Detection electronics described previously consist of input pre-amplifiers connected to the receive coils, synchronous demodulators the reference signals of which are synchronized to the transmit signal and are connected to the said pre-amplifiers, low-pass filters connected to the said synchronous demodulators to remove transmit frequency (carrier) signals and harmonics, processing means connected to the said lowpass filters that apply arithmetic algorithms to the low-pass filter outputs to determine whether the ball is "in" or "out." The tennis ball is manufactured to contain magnetically permeable material such as finely ground iron filings.

The arrangement described in PCT /AU88/00229 typically utilises two synchronous demodulators are connected to each pre-amplifier. The references of each are synchronized to the transmit signal. One with a reference phase selected substantially to pass only reactive signals to its associated low-pass filter. The reference phase of the other said synchronous demodulator being selected so the other said synchronous demodulator substantially pass only resistive signals to its associated low-pass filter. If the magnetic material in the ball is substantially reactive only, magnetically permeable material such as ferrite or fine iron filings, then the "resistive channel" will substantially not pass ball related signals, but will pass noise or resistive signals. Noise or resistive signals can be generated by carbon fibre tennis rackets for example. Thus the resistive channel can be used to determine "interference."

One feature of the system described in PCT /AU88/00229 is that it requires a separate coil system for each straight line. There is a significant problem with this arrangement. The problem is that where the straight lines are intersecting as happens where they form a corner or crossing there will be either interference between the coils or detection becomes ineffective in this location. One reason for this is in the specific way in which the elements are arranged. In the previous example a first coil crossing a second coil can provide an effective shorted turn or effective shorting of one transmit coil by the other. This is because a transmit coil is generally driven by a low impedance source.

This could mean that the coils should be kept from overlaying one another. But this would have the result that an important part of the tennis court line system would not be covered by the ball location detection arrangement. Further, at the end of such non-overlapping coils the arrangement could provide an anomalous detection situation. This could lead to indecision and difficulties in respect to umpiring a game of tennis.

This then is the problem to which this invention is directed.

It has been discovered that for a line intersection that involves either a corner or crossing arrangement the coils associated with the lines cannot be simply laid on top of one another and driven at the same frequency. This is because of several reasons, the most important of which is that the field strength will be different near the overlap compared to areas of non-overlap. Thus the receive coils must be of complex shape in the overlap area compared to the non-overlap areas and the algorithm for the overlap area will need to be different to the non-overlap area. Installing the coils requires burying the coils beneath the tennis court. This can be accomplished by cutting grooves in the court, placing the coils in the grooves and then filling the grooves. Complex and exacting coil shapes will tend to make installation expensive.

The answer is to drive the coils servicing the intersecting lines at different frequencies. In preference the frequencies should be sufficiently different so that the signals at one frequency do not interfere with signals of the other frequencies. This for example requires the Fourier components of the transmit signals not to produce a beat signal that is passed by the synchronous demodulators and low-pass filters associated with it.

The invention may be said to reside in an arrangement for detection of the location of a magnetically permeable ball relative to a playing surface line including first transmit means adapted to create a first electromagnetic field or fields, second transmit means adapted to create a second electromagnetic field or fields which are distinguishable from the said first electromagnetic field or fields by reason of being of different frequency spectra and the first and second transmit means being each substantially uninfluenced by the field or fields created by the other, first receiving and second receiving means adapted to detect the first and the second electromagnetic fields respectively, and where both receiving means and both transmitting means include in each case at least one coil which is located beneath intersecting boundary lines of a tennis court and are adapted to and located so that perturbations to the first and second electromagnetic fields resulting from the ball moving within the influence of the fields produce a signal indicative of the location of the ball relative to the playing surface line. Due to the different frequency spectra and the transmit means being substantially uninfluenced by each other the coils can be overlapped. Consequently the electromagnetic fields created by the transmit means will be independent of each other. An object made of permeable material moving with in the fields will cause field perturbations which can be detected with the receive means.

In relation to the game of tennis the invention can be said to reside in an arrangement for detection of the location of a magnetically permeable tennis ball relative to a tennis court line including first transmit means adapted to create a first electromagnetic field or fields, second transmit means adapted to create a second electromagnetic field or fields which are distinguishable from the said first electromagnetic field or fields by reason of being of different frequency spectra and the first and second transmit means being each substantially uninfluenced by the field or fields created by the other, first receiving and second receiving means adapted to detect the first and the second electromagnetic fields respectively, and where both receiving means and both transmitting means include in each case at least one coil which is located beneath intersecting boundary lines of a tennis court and are adapted to and located so that perturbations to the first and second electromagnetic fields resulting from the tennis ball moving within the influence of the fields produce a signal indicative of the location of the ball relative to the tennis court line.

In preference the coils of the first and second transmit means are connected in series with filtering means the frequency characteristics of which are such that there will be presented by the series combination a high impedance at the transmit frequency or frequencies of the other transmit means. The filtering means effect the isolation of the transmit means from each other. Without such filtering means the fields of the coils will interact in a fashion analogous to an electrical transformer.

If for example each transmit means comprises one transmit coil then the filtering means for one coil is a low pass filter and for the other is a high pass filter. The transmit coil to which the high pass filter is attached would be driven with a signal higher than the signal driving the other transmit coil. The pass band characteristics of the low and high pass filters would substantially prevent the field created by one of the transmit coils being affected by the other transmit coil.

It is desirable that the arrangement be one in which both said first and said second receiving means are each adapted to effect a cancelling of electromagnetic signals emanating from far field electromagnetic signal source. Low frequency electromagnetic waves propagate substantial distances. As a result even low power electromagnetic waves of unknown source can propagate sufficient distances to be received by a simple loop antenna. If the receive means comprises a simple loop antenna then the receive means may be sensitive to interference from sources distant to the tennis court. As only a region near a line of a tennis court is of interest then insensitivity to far field sources is desirable.

In preference the first and second transmit coils include respectively a first and a second recto-linear transmitting loop antennae adapted to be resonated by substantially a first and a second parallel capacitor respectively with any series inductance at a first and a second resonant frequency respectively, the first recto-linear transmitting loop antenna is located beneath and aligned with a first boundary line of a tennis court and the second recto-linear transmitting loop antenna is located beneath and aligned with a second boundary line of the tennis court, the second boundary line intersecting the first said boundary line, and the longer sides of each transmitting antennae being co-linear with the respective boundary lines and the plane of the antennae being substantially parallel with a plane defined by the tennis court. Use of recto-linear transmitting loop antennae allow for relatively simple installation of the arrangement. This is a result of the independence of the created electromagnetic field and means that complex loop or coil shapes are not required.

It is desirable that said first and second transmit coils are adapted to be resonantly driven. This can be achieved by resonating the transmit coil with sufficient capacitance at the desired frequency of transmission. This generally provides and efficient coil drive.

It is preferably that the invention be further characterised by the electromagnetic fields created being the result of the flow of substantially sinusoidal currents. This simplifies the filtering means and produces alternating electromagnetic fields substantially of the same frequency as the sinusoidal currents.

In preference the first and second receiving means include respectively a first recto-linear loop receiving antenna substantially co-planar with the first transmitting antenna, a second recto-linear loop receiving antenna substantially co-planar with the second transmitting antenna, each receiving antenna comprising a pair of co-planar component loops characterised by smaller sides of each component loop being substantially half the length of smaller sides of the respective transmitting antennae, the pairs of receiving antennae being substantially centered with respect to the respective transmitting antennae, and the longer sides of each receiving antennae being substantially parallel to the longer sides of the respective transmitting antennae.

In a further preferred arrangement the first and second receive means include respectively a first and a third recto-linear loop receiving antennae substantially co-planar with the first transmitting antenna and a second and fourth recto-linear loop receiving antennae substantially co-planar with the second transmitting antenna, the first and second receiving antennae comprising respectively a pair of co-planar component loops characterised by the smaller sides of each component loop being substantially half the length of the smaller sides of the respective transmitting antenna, the third and the fourth receiving antennae comprising respectively being three co-planar component loops characterised by the smaller sides of each component loop being substantially a third the length of the smaller sides of the respective transmitting antennae, the pairs of receiving antennae being substantially centred with respect to the respective transmitting antennae, the three co-planar component loops of receiving antennae being substantially centred with respect to the respective transmitting antennae, and the longer sides of each receiving antennae being substantially parallel to the longer sides of the respective transmitting antennae. This arrangement of the receive coils can assist in determining the location of the ball relative to a line. The three co-planar component loops allow the near vicinity of the line to be investigated in detail whilst the two co-planar component loops provide a signal indicative of to which side of the line the ball was moving.

It is invention is preferably further characterised in that the receiving antenna are connected to detection electronics including synchronous demodulator means connected and arranged so that only that portion of any received signal with greatest expected amplitude will be used for an output signal. Movement of a permeable ball through the fields will cause amplitude modulation of the sinusoidal signal detected by the receiving means. Synchronous demodulator means can be used to determine whether the detected or received signal characterised by amplitude modulation a substantial reactive phase component indicative of a tennis ball or a substantial resistive phase component indicative of interference or noise.

Alternatively the invention may be said to reside in a method of detecting the location of tennis balls where there are intersecting tennis court boundary lines in which there are at least two transmit coils and two correspondingly located receive coils for the purpose of locating a magnetically permeable ball relative to the court lines, each set of transmit and receive coils being located beneath and aligned with a respective one of intersecting tennis court lines, the method including the step of driving a first of the transmit coils with an electromagnetic signal having a frequency which is different from that frequency at which the other of the transmit coils is driven. It will be appreciated that the arrangements described above can be used in respect to a method of detecting the location of tennis balls in relation to boundary lines.

The invention is accordingly is directed to being a means such that accuracy of detection can be extended to corners and crossing locations of the lines of a tennis court.

According to one form the invention this can be said to reside in a tennis ball relative location system of the type described in which there are coils for the purpose of locating a ball relative to the court lines, the coils being each located beneath and aligned with respective crossing or joining straight lines and in an overlapping relationship characterised, driving means adapted to effect a driving of each of the coils and to drive each respective coil at a frequency which is different from that frequency at which the other coil is driven.

As a further preferred feature each one of the coils is adapted to have a substantially selectively increased impedance to induced currents at the frequency at which the the other coil is being driven as compared to the frequency at which the first coil is driven.

This is achieved by in preference providing an inline filter providing in selective manner the appropriate impedance. In order that the spatial impedance of each line in the overlap area does not affect the transfer function of the other, each line in preference should be of substantially high impedance at the transmit signal frequencies of the lines it overlaps. This high impedance in preference should have a bandwidth greater than the "ball" signal for any possible ball trajectory on each side of the carrier transmit frequency. The ball signal effectively amplitude modulates the transmit signal.

The Fourier components form two sidebands on each side of the transmit signal frequency.

A simple means of achieving this is to drive the transmit coils with current sources. However, it is highly desirable to transmit signals generated using large currents in order to obtain good signal to noise ratios. Current sources producing large currents into coils are very power inefficient compared to inductive-capacitive or resonantly driven coils. Consequently resonantly driven coils are preferred. However, any overlapping coil using a resonator cannot simply consist of a single capacitor connected across a transmit coil, but in preference should also contain a resonant trap which creates a high impedance at the frequency of the transmitted frequency of the coil overlapped.

The invention will now be described as exhibited in a preferred embodiment with reference to the accompanying Figures.

Figure 2:
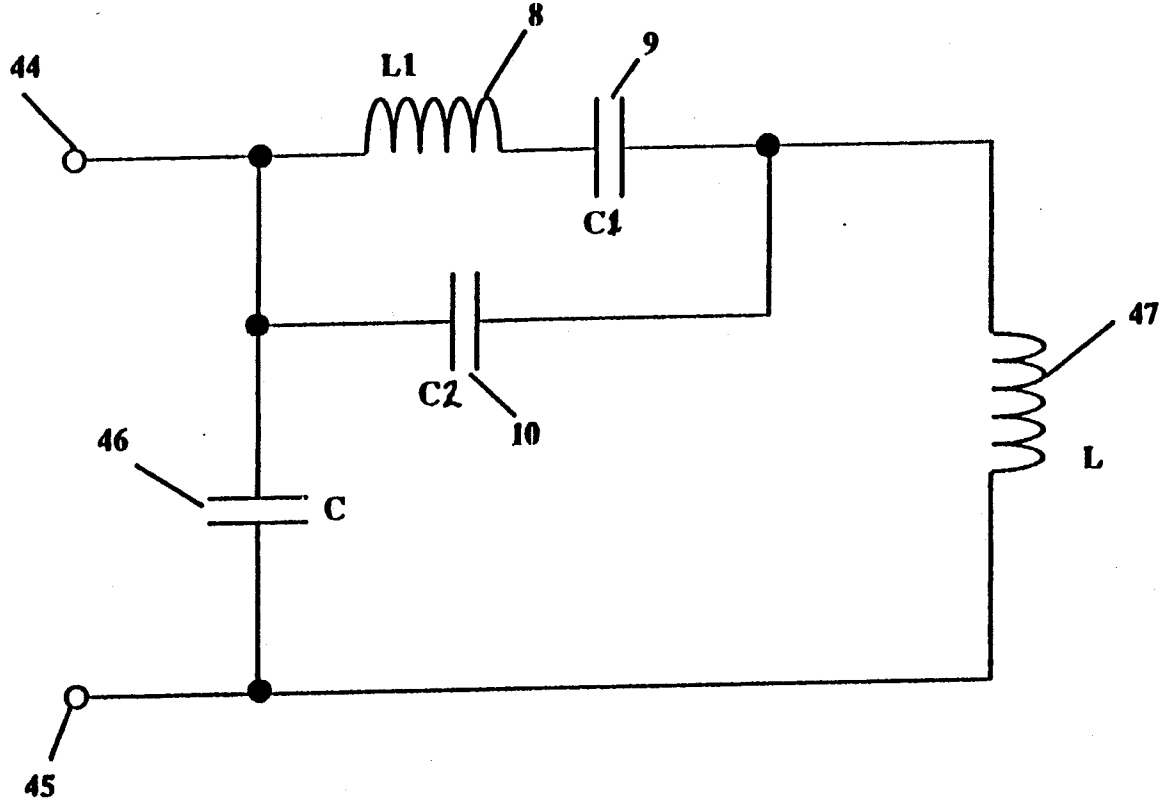
Figure 3:
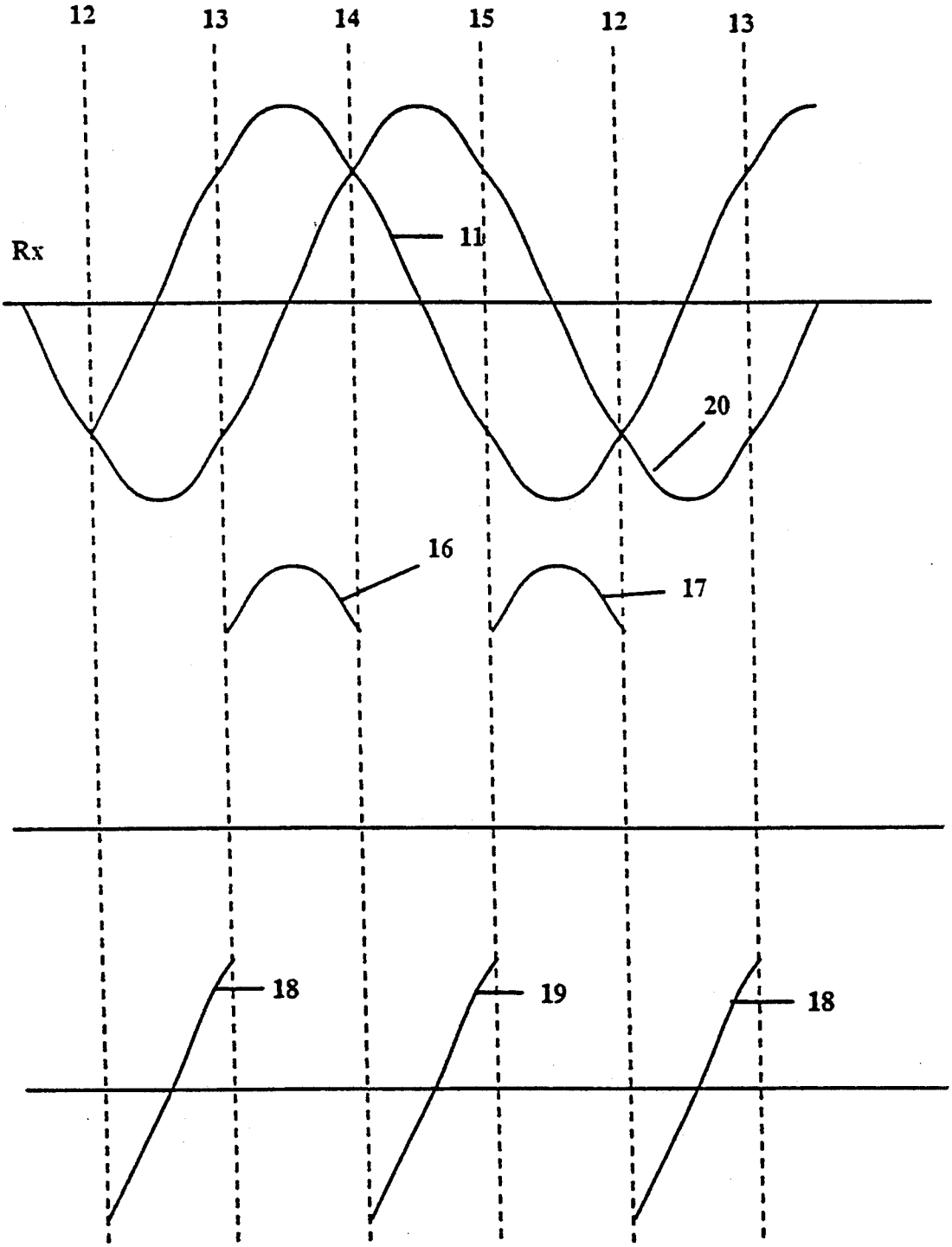
Figure 4:
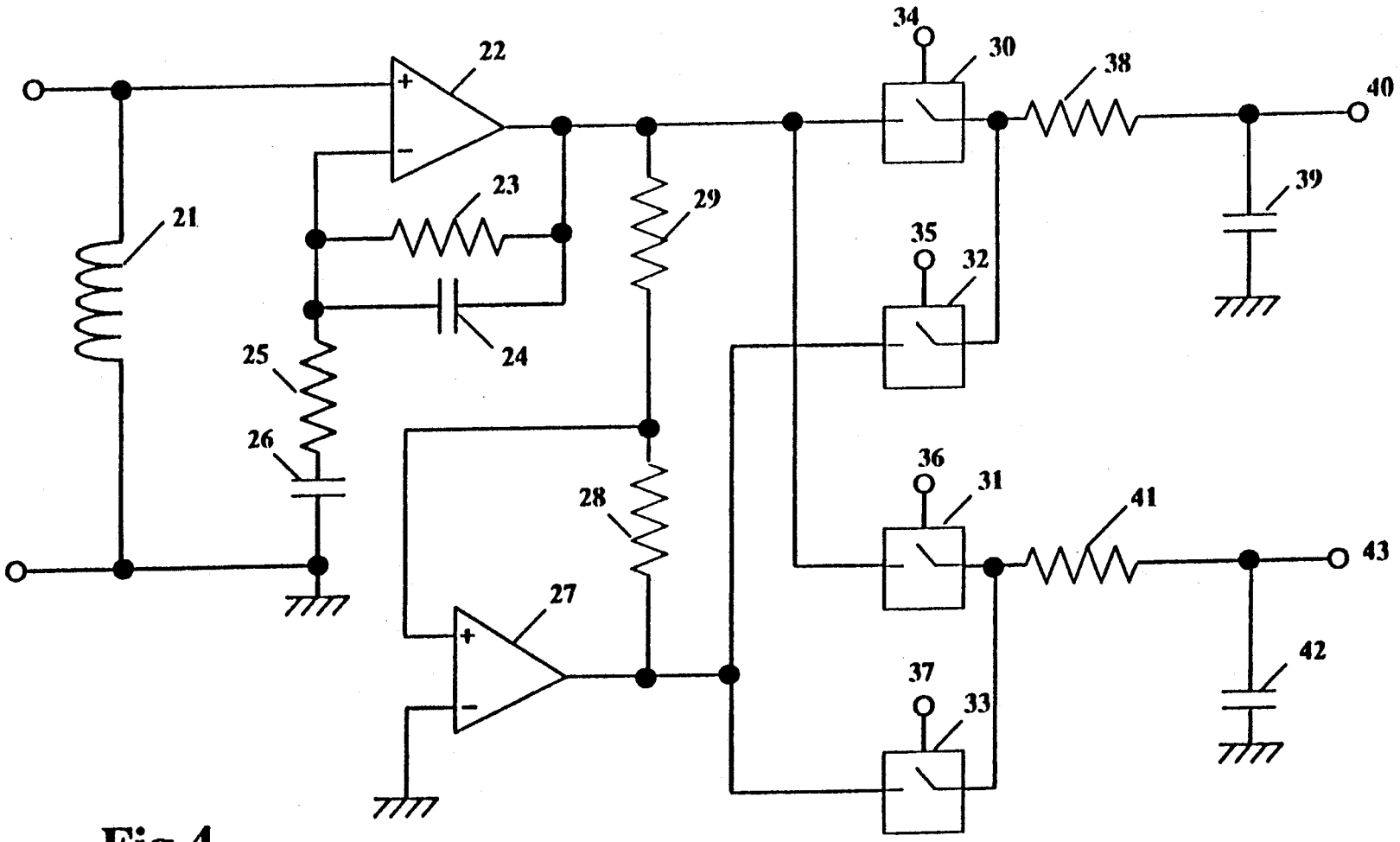
Figure 5:
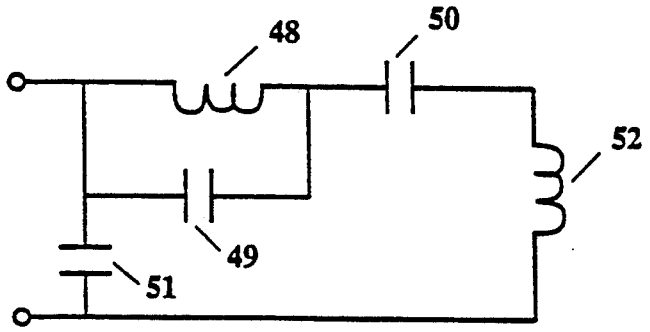
Figure 5B:
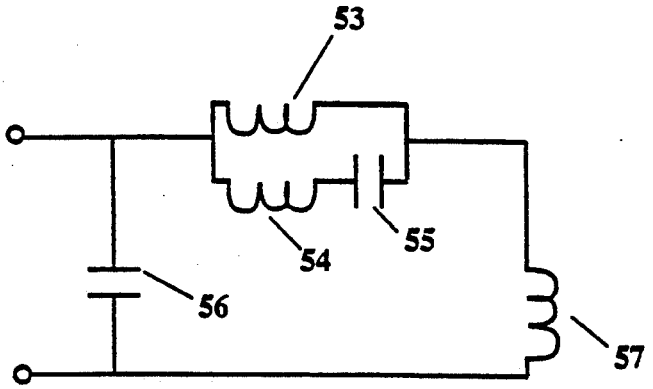

FIG. 1 is a schematic diagram of an arrangement to drive a transmit coil at a high frequency, FIG. 2 is a schematic diagram of an arrangement to drive a transmit coil at a low frequency, FIG. 3 illustrates an typical received waveforms and the portions of the waveforms that are synchronously demodulated, FIG. 4 is a schematic diagram of the detection electronics, FIG. 5 is a schematic diagram of further arrangements to drive transmit coils at low and high frequencies, and FIG. 6 is a sketch of the arrangement of the coils or loops as applied to a part of a tennis court.

Two preferred embodiments of such resonator arrangements are given in FIGS. 1 and 2.

FIG. 1 is an arrangement for a higher frequency transmission, low frequency high impedance whereas FIG. 2 is an arrangement for a lower frequency transmission, high frequency high impedance.

With reference to the drawings, the transmit coil 1 has an inductance L typically 22 $\mu$H. The transmit power source is applied to terminals 2 and 3. Across terminals 2 and 3 is connected a capacitor 4 of value C, typically 0.72 $\mu$F. In FIG. 1, an inductor 4 of inductance $L_1$ (typically 44 $\mu$H) is connected to 2. Across inductor 4 is connected a parallel capacitor of value $C_1$, typically 1.44 $\mu$F. Inductor $L_1$ and capacitor $C_1$ are also connected to an inductor 7 of value $L_2$ (typically 14.7 $\mu$H) in series with the transmit coil 1. The other end of the series combination of 7 and 1 is terminal 3.

In FIG. 2, an inductor 8 of inductance $L_1$ (typically 44 $\mu$H) is connected in series with a capacitance 9 of value $C_1$ (typically 1.44 $\mu$F) to 44. Across the series combination of inductor 8 and capacitor 9 is connected a parallel capacitor 10 of value $C_2$, typically 0.48 $\mu$F. Capacitor 10 is also connected to a transmit coil 47. The other end of transmit coil 47 is connected to terminal 45.

In order that the resonator in FIG. 1 is of high impedance at the lower frequency $\omega_l$ (in radians per second) as a load to the transmit coil, the following condition must be substantially satisfied:

$$1/(L_1C_1)=\omega_l^2$$

In order that the resonator in FIG. 2 is of high impedance at the higher frequency $\omega_h$ (in radians per second) as a load to the transmit coil, the following condition must be substantially satisfied:

$$C_1(1-\omega_h^2L_1C_2)=C_2.$$

In order that the resonator of FIG. 1 be resonant at $\omega_h$ at the terminals, the following condition must be substantially satisfied:

$$C\omega_h^2(L+L_2+L_1/(1-L_1C_1\omega_h^2))=1.$$

In order that the resonator of FIG. 2 be resonant at $\omega_l$ at the terminals, the following condition must be substantially satisfied:

$$C\omega_l^2(L+1/(\omega_l^2(C_1+C_2/(1-\omega_l^2L_1C_2))))=1.$$

There are yet other combinations of inductors and capacitors that can present a high impedance load to the transmit coil at one transmit frequency while being (high impedance) resonant at the other transmit frequency. However the arrangements shown are simple and have relative low inductor energy storage requirements and thus are low cost.

As it is preferable to have $\omega_h$ harmonically related to $\omega_l$ to avoid frequency beating and at least about double the frequency so as to avoid critical inductor and capacitor values. Preferably, the inductor and capacitor values should not be much more than double so that the resistive demodulators are still reasonably sensitive to resistive components in typical metal artifacts rather than substantially just the reactive component which is the case if $\omega_h$ is too high.

Thus if $\omega$h is exactly double $\omega_l$ and synchronized to it, the above conditions will be satisfied. Further, the second harmonic will substantially not be detected by the fundamental synchronous demodulators if the reference digital signals fed to these only contain odd harmonics. Similarly the second harmonic synchronous demodulators will be substantially insensitive to the fundamental if the reference digital signals fed to these only contain odd harmonics. For $\omega_h=2\times\omega_l$ and if the reference digital signals fed to the synchronous demodulators only contain odd harmonics, the resonators described above are implemented at each transmit line, then the above conditions will be satisfied and one line will not interfere with the other.

In Australian provisional patent application PI2801 two methods for reducing external magnetic interfering signals from far field sources such as lightning or power lines are described. One method achieves this by balancing the receive coils to far fields, and the other by substantially cancelling synchronous signals by balanced synchronous demodulation.

According to a further aspect of this invention this is then directed to the concept of providing that some lesser proportion of the receive signal is transmitted and especially such that not all of the usual full or half wave signal common in phase-locked amplifiers or balanced demodulators (in radios) is passed, but in preference half or less than half of the signal is passed during periods when the receive component being detected is not relatively near zero, while still maintaining fully balanced synchronous demodulators.

This is illustrated in FIG. 3. In this Figure, a receive signal 11 shown is for the sake of example, only reactive in content. It is substantially sinusoidal in shape. Synchronous demodulator switching times occur at times 12, 13, 14 and 15 which are cyclically repeated. In thus example, the in-phase resistive synchronous demodulator switch is turned "on" during the period between 12 and 13, and "off" during other periods. The in-phase reactive synchronous demodulator switch is turned "on" during the period between 13 and 14, and "off" during other periods. The out-of-phase resistive synchronous demodulator switch is turned "on" during the period between 14 and 15, and "off" during other periods. The out-of-phase reactive synchronous demodulator switch is turned "on" during the period between 15 and 12, and "off" during other periods.

In this example the resulting passed components are shown as 16 in the case of the in-phase reactive component, 17 in the case of the out-of-phase reactive component, 18 in the case of the in-phase resistive component, 19 in the case of the out-of-phase resistive component. Any purely resistive component would have a phase at quadrature to 11, such as signal 20. As can be seen by 16 and 17, the purely reactive signal is only passed by the synchronous demodulators when the received signal is near the peaks and not near zero. The reactive signal shown in this example is however relatively small when the resistive synchronous demodulators pass the received signal. The same situation occurs for the purely resistive component, that is the purely resistive signal is only passed by the synchronous demodulators when the received signal is near the peaks and not near zero. The resistive signal is however relatively small when the reactive synchronous demodulators pass the received signal.

FIG. 4 shows an example of two fully balanced demodulators, which can be used to implement the above demodulation concepts, namely passing the signal to the low-pass filters only near the peaks of the component demodulated.

In FIG. 4, a receive coil 21 is connected to a preamplifier-cum-band-pass filter consisting of op-amp 22, parallel feedback resistor 23 and capacitor 24, and a series resistor 25 and capacitor 26 connected between the op amp inverting input and ground, to which one end of 21 is also connected. The output of the op-amp is connected via a resistor 29 to an inverting op amp 27 which has a feedback resistor 28 connected between the output of 27 and the inverting in put of 27. The output of 22 feeds to the analogue inputs of two switches, 30 and 31. The output of 27 feeds to the analogue inputs of two switches, 32 and 33. The digital control of 30 is controlled by a signal at 34 and in the above example, could turn 30 "on" between the periods of 12 and 13 and the digital control of 32 is controlled by a signal at 35 and in the above example, could turn 32 "on" between the periods of 13 and 14. The digital control of 31 is controlled by a signal at 36 and in the above example, could turn 31 "on" between the periods of 14 and 15 and the digital control of 33 is controlled by a signal at 37 and in the above example, could turn 33 "on" between the periods of 15 and 12. The analogue outputs of 30 and 32 are combined and fed to resistor 38 which is connected to a capacitor 39 to form a low-pass filter. The other end of 40 is connected to ground.

The voltage across 39 is essentially proportional to the resistive component and can be used to determine the level of interference. The analogue outputs of 31 and 33 are combined and fed to resistor 41 which is connected to a capacitor 42 to form a low-pass filter. The other end of 42 is connected to ground. The voltage across 42 is essentially proportional to the reactive component and can be used to determine the level of ball related signals and hence the whether the ball is "in" or "out" by means of an algorithm.

If the invertor consisting of 27, 28 and 29 has a gain of substantially $-1$, and the demodulate periods shown in FIG. 3 are substantially equal, then the low-pass filter outputs 40 and 43 in FIG. 4 from the capacitors 39 and 42 respectively, essentially are insensitive to asynchronous components other than those within the band width of the low-pass filter about the sidebands carrier or odd harmonics of the carrier.

In FIG. 5(*a*) a further low frequency transmission, high frequency high impedance circuit. The circuit operates in a similar fashion to that described earlier. The values of the component can be inductor 48 44 $\mu$H, capacitor 49 0.36 $\mu$F, capacitor 50 1.08 $\mu$F, capacitor 51 2.9 $\mu$F and the coil inductance 52 22 $\mu$H.

In FIG. 5(*b*) a further high frequency transmission, low frequency high impedance circuit. The circuit operates in a similar fashion to that described earlier. The values of the component can be inductor 53 132 $\mu$H, inductor 54 44 μH, capacitor 55 0.33 μF, capacitor 56 0.72 μF and the coil inductance 57 22 μH.

Two preferred layout of transmit and receive coils are illustrated in FIG. 6 using a tennis court as an example. For the sake of clarity full court coverage is not illustrated. The Figure gives a plan view and it will be understood that the coils are buried beneath the line of the tennis court. Further, the purpose of FIG. 6 is to illustrate the layout concept and not give exact placement dimensions. It will be appreciated that the dimensions of the coils illustrated are for illustration and in practice the corresponding coil sides would lie within the same vertical plane. The layouts illustrated provide for far field cancelling or internal cancelling of far fields.

That shown in FIG. 6(*a*) comprises for each line 58 and 59 a single transmit coil 60 and 61 respectively. For line 58 there are two receive coils 62 and 63, and for line 59 receive coils 64 and 65. Receive coils 62 and 63 are wound so that a uniform field will produce outputs of opposing sense. Likewise for receive coils 64 and 65. Consequently the nett output of the receive coils will be substantially zero for uniform fields. Far field sources can be considered as uniform fields for practical purposes. A ball moving within the vicinity of the lines 58 and 59 will cause field perturbations which will not result in cancelling outputs of the receive coils.

In FIG. 6(*b*) a similar layout to that illustrated in FIG. 6(*a*) is given. This here differs by the inclusion of a second set of receive antennae 66, 67, 68 and 69, 70, 71. The sets of three co-planar recto-linear receive antennae provide output signals which can be used in conjunction with the sets of two co-planar recto-linear receive antennae to assist in determination of the location of a ball relative to the lines 72 and 73.

It will be appreciated that there are a number of other embodiments of the invention that would be apparent to those skilled in the art. Such embodiments would fall with in the spirit of the invention.

I claim:

1. An arrangement for detection of the location of a magnetically permeable tennis ball relative to a tennis court line including first transmit means adapted to create a first electromagnetic field or fields, second transmit means adapted to create a second electromagnetic field or fields which are distinguishable from the said first electromagnetic field or fields by reason of being of different frequency spectra and the first and second transmit means being each substantially uninfluenced by the field or fields created by the other, first receiving and second receiving means adapted to detect the first and the second electromagnetic fields respectively, and where both receiving means and both transmitting means include in each case at least one coil which is located beneath intersecting boundary lines of a tennis court and are adapted to and located so that perturbations to the first and second electromagnetic fields resulting from the tennis ball moving within the influence of the fields produce a signal indicative of the location of the ball relative to the tennis court line.

2. An arrangement as in claim 1 and where the coils of the first and second transmit means are connected in series with filtering means the frequency characteristics of which are such that there will be presented by the series combination a high impedance at the transmit frequency or frequencies of the other transmit means.

3. An arrangement as in claim 1 in which both said first and said second receiving means are each adapted to effect a cancelling of electromagnetic signals emanating from far field electromagnetic signal source.

4. An arrangement as in claim 1, further characterised in that said first and second transmit coils include respectively a first and a second recto-linear transmitting loop antennae adapted to be resonated by substantially a first and a second parallel capacitor respectively with any series inductance at a first and a second resonant frequency respectively, the first recto-linear transmitting loop antenna is located beneath and aligned with a first boundary line of a tennis court and the second recto-linear transmitting loop antenna is located beneath and aligned with a second boundary line of the tennis court, the second boundary line intersecting the first said boundary line, and the longer sides of each transmitting antennae being co-linear with the respective boundary lines and the plane of the antennae being substantially parallel with a plane defined by the tennis court.

5. An arrangement as in claim 4 further characterised in that said first and second transmit coils are adapted to be resonantly driven.

6. An arrangement as in claim 1 further characterised by the electromagnetic fields created being the result of the flow of substantially sinusoidal currents.

7. An arrangement as in claim 6 where the first and second receiving means include respectively a first recto-linear loop receiving antenna substantially co-planar with the first transmitting antenna, a second recto-linear loop receiving antenna substantially co-planar with the second transmitting antenna, each receiving antenna comprising a pair of co-planar component loops characterised by smaller sides of each component loop being substantially half the length of smaller sides of the respective transmitting antennae, the pairs of receiving antennae being substantially centred with respect to the respective transmitting antennae, and the longer sides of each receiving antennae being substantially parallel to the longer sides of the respective transmitting antennae.

8. An arrangement as in claim 4 wherein the first and second receive means include respectively a first and a third recto-linear loop receiving antennae substantially co-planar with the first transmitting antenna and a second and fourth recto-linear loop receiving antennae substantially co-planar with the second transmitting antenna, the first and second receiving antennae comprising respectively a pair of co-planar component loops characterised by the smaller sides of each component loop being substantially half the length of the smaller sides of the respective transmitting antenna, the third and the fourth receiving antennae comprising respectively antenna, the third and the fourth receiving antennae comprising respectively being three co-planar component loops characterised by the smaller sides of each component loop being substantially a third the length of the smaller sides of the respective transmitting antennae, the pairs of receiving antennae being substantially centred with respect to the respective transmitting antennae, the three co-planar component loops of receiving antennae being substantially centred with respect to the respective transmitting antennae, and the longer sides of each receiving antennae being substantially parallel to the longer sides of the respective transmitting antennae.

9. An arrangement for detection of the location of a magnetically permeable tennis ball relative to a tennis court line including first electromagnetic field radiating means being a first recto-linear transmitting loop antenna adapted to be resonated substantially by a first parallel capacitor with a series inductance at a first resonant frequency and create a first electromagnetic field, second electromagnetic field radiating means being a second recto-linear transmitting loop antenna adapted to be resonated substantially by a second parallel capacitor with a series inductance at a second resonant frequency and create a second electromagnetic field, the recto-linear transmitting loop antennae being buried beneath and aligned with a first and a second boundary lines of a tennis court respectively, the longer sides of each transmitting antennae being co-linear with the respective boundary lines and a plane defined by the longer sides of the transmitting antennae being substantially parallel with a plane defined by the tennis court, a first and a second receiving means being respectively at least a first pair of recto-linear loop receiving antennae substantially co-planar with the first transmitting antenna and at least a second pair of recto-linear loop receiving antennae substantially co-planar with the second transmitting antenna, the longer sides of each pair of receiving antennae being parallel to the longer sides of the respective transmitting antennae, the smaller sides of each pair of receiving antennae being substantially half the length of the smaller sides of the respective transmitting antennae, the pairs of receiving antennae being substantially centred with respect to the respective transmitting antennae, and the receiving antennae being adapted and located so that perturbations to the first and second electromagnetic fields resulting from the tennis ball moving within the influence of the fields produce a signal indicative of the location of the ball relative to the tennis court line.

10. An arrangement as in claim 9 further characterised in that the receiving antenna are connected to detection electronics including synchronous demodulator means connected and arranged so that only that portion of any received signal with greatest expected amplitude will be used for an output signal.

11. An arrangement to aid in the location of a magnetically permeable tennis ball in respect to a line defining the court for the playing of a game of tennis wherein transmit coils beneath and aligned with the line are adapted to transmit alternating magnetic field at selected frequencies and receiver coils located so that perturbations to any field resulting from the magnetically permeable tennis ball moving within the influence of the field are detectable by one or more receiver coils connected to detection electronics in which there are at least two transmit coils located in overlapping relationship each one of the coils being adapted to have a comparatively high impedance to induced currents at the frequency at which the other coil is adapted to be driven.

12. A method of detecting the location of tennis balls where there are intersecting tennis court boundary lines in which there are at least two transmit coils and two correspondingly located receive coils for the purpose of locating a magnetically permeable ball relative to the court lines, each set of transmit and receive coils being located beneath and aligned with a respective one of intersecting tennis court lines, the method including the step of driving a first of the transmit coils with an electromagnetic signal having a frequency which is different from that frequency at which the other of the transmit coil is driven.

13. A method of detecting the location of a magnetically permeable tennis ball where there are intersecting tennis court boundary lines in the game of tennis in which there are;

a first and a second means adapted to transmit a first electromagnetic signal and a second electromagnetic signal respectively;

a first receiving and a second receiving means adapted to receive the first and the second electromagnetic signals respectively;

a first filtering and a second filtering means adapted to prevent the first transmitting means from receiving the second electromagnetic signal and the second transmitting means from receiving the first electromagnetic signal respectively; and where both receiving means and both transmitting means include at least one coil or loop which is buried below the intersecting boundary lines the method comprising the steps of transmitting a first and a second electromagnetic signals which have a frequency which is different one from the other into respectively the first and the second transmit coils.

14. A method of detecting the location of tennis balls where there are intersecting tennis court boundary lines as in claim 13 where the means adapted to transmit a first electromagnetic signal and a second electromagnetic signal respectively are each comprised of a resonantly driven coil or loop in series with which is connected the first and the second filterin means respectively.

15. A method for detecting the location of magnetically permeable tennis balls where there are intersecting tennis court boundary lines as in claim 13 in which the said first and said second receiving means are adapted to effect an internal cancelling of electromagnetic signals emanating from far field electromagnetic radiation.

16. A method of detecting the location of magnetically permeable tennis balls where there are intersecting tennis court boundary lines as in claim 13, further characterised in that said first and second transmit coils comprise respectively a first and a second recto-linear transmitting loop antennae adapted to be resonated by substantially a first and a second parallel capacitor respectively with any series inductance at a first and a second resonant frequency respectively, which are located beneath and aligned with a first boundary line and a second boundary line intersecting the first said boundary line respectively of a tennis court, with longer sides of each transmitting antennae being co-linear with the respective boundary lines and parallel with a plane defined by the tennis court.

17. A method detecting the location of magnetically permeable tennis balls where there are intersecting tennis court boundary lines as in claim 13, where the first and second receiving coils are comprised of respectively a first recto-linear loop receiving antenna substantially co-planar with a first transmitting antenna comprising the first transmit coil and a second recto-linear loop receiving antenna substantially co-planar with a second transmitting antenna comprising the second transmit coil, each receiving antenna comprising a pair of co-planar component loops characterised by smaller sides of each component loop being substantially half the length of smaller sides of the respective transmitting antennae, the pairs of receiving antennae being substantially centred with respect to the respective transmitting antennae, and the longer sides of each receiving antennae being parallel to the longer sides of the respective transmitting antennae.

18. A method to aid in location of a ball for line calls with intersecting boundary lines as in claim 13 wherein the first and second receive coils comprise respectively a first and a third recto-linear loop receiving antennae substantially co-planar with the first transmitting antenna and a second and fourth recto-linear loop receiving antennae substantially co-planar with the second transmitting antenna, the first and second receiving antennae comprising respectively a pair of co-planar component loops characterised by the smaller sides of each component loop being substantially half the length of the smaller sides of the respective transmitting antenna, the third and the fourth receiving antennae comprising respectively being three co-planar component loops characterised by the smaller sides of each component loop being substantially a third the length of the smaller sides of the respective transmitting antennae, the pairs of receiving antennae being substantially centred with respect to the respective transmitting antennae, the three co-planar component loops of receiving antennae being substantially centred with respect to the respective transmitting antennae, and the longer sides of each receiving antennae being parallel to the longer sides of the respective transmitting antennae.

19. A method of location of magnetically permeable tennis balls with respect to intersecting boundary lines in a tennis court of a type wherein a transmit coil beneath and aligned with a boundary line is caused to transmit an alternating magnetic field and a receiver coil is located so that perturbations to the field resulting from a magnetically permeable tennis ball moving within the influence of the field are detectable by the receiver coil connected to detection electronics the improvement further comprising:

a first and a second electromagnetic field radiating means being respectively a first and a second recto-linear transmitting loop antennae adapted to be resonated by substantially a first and a second parallel capacitor respectively and with a series inductance at a first and a second resonant frequency respectively, buried beneath and aligned with a first and a second boundary lines of a tennis court respectively, the longer sides of each transmitting antennae being co-linear with the respective boundary lines and a plane defined by the longer sides of the transmitting antennae being parallel with a plane defined by the tennis court;

a first and a second receiving means being respectively at least a first pair of recto-linear loop receiving antennae substantially co-planar with the first transmitting antenna and at least a second pair of recto-linear loop receiving antennae substantially co-planar with the second transmitting antenna, the longer sides of each pair of receiving antennae being parallel to the longer sides of the respective transmitting antennae, the smaller sides of each pair of receiving antennae being substantially half the length of the smaller sides of the respective transmitting antennae, and the pairs of receiving antennae being substantially centred with respect to the respective transmitting antennae.

20. A method of detecting the location of tennis balls where there are intersecting tennis court boundary lines as in claim 19 where the coils of the first and the second receiving means are respectively a first and a third recto-linear loop receiving antennae substantially co-planar with the first transmitting antenna and a second and fourth recto-linear loop receiving antennae substantially co-planar with the second transmitting antenna, the first and second receiving antennae comprising respectively a pair of co-planar component loops characterised by the smaller sides of each component loop being substantially half the length of the smaller sides of the respective transmitting antenna, the third and the fourth receiving antennae comprising respectively being co-planar component loops characterised by the smaller sides of each component loop being substantially a third the length of the smaller sides of the respective transmitting antennae, the pairs of receiving antennae being substantially centred with respect to the respective transmitting antennae, the three co-planar component loops of receiving antennae being substantially centred with respect to the respective transmitting antennae, and the longer sides of each receiving antennae being parallel to the longer sides of the respective transmitting antennae.

21. A method of detecting the location of a magnetically permeable tennis ball relative to a line defining the court for the playing of a game of tennis wherein a transmit coil beneath and aligned with each of the lines is adapted to transmit an alternating magnetic field and a receiver coil in respect to each line is located so that perturbations to the field resulting from the magnetically permeable tennis ball moving within the influence of the field are detectable by the receiver coil connected to detection electronics comprising:

a first and a second electromagnetic field radiating means being respectively a first and a second recto-linear transmitting loop antennae adapted to be resonated by substantially a first and a second parallel capacitor respectively and with any series inductance at a first and a second resonant frequency respectively, buried beneath and aligned with first and second intersecting boundary lines of a tennis court respectively, the longer sides of each transmitting antennae being co-linear with the respective boundary lines and a plane defined by the longer sides of the transmitting antennae being parallel with a plane defined by the tennis court;

a first and a second receiving means being respectively at least a first pair of recto-linear loop receiving antennae substantially co-planar with the first transmitting antenna and at least a second pair of recto-linear loop receiving antennae substantially co-planar with the second transmitting antenna, the longer sides of each pair of receiving antennae being parallel to the longer sides of the respective transmitting antennae, the smaller sides of each pair of receiving antennae being substantially half the length of the smaller sides of the respective transmitting antennae, and the pairs of receiving antennae being substantially centred with respect to the respective transmitting antennae.

22. An arrangement for detection of location of a tennis ball relative to a court line of a type wherein transmit coils beneath and aligned with the line are adapted to transmit an alternating magnetic field and receiver coils are beneath and aligned with the line and adapted to and located so that any changes to a field resulting from a magnetically permeable tennis ball moving within the influence of the field are detectable by the receiver coil connected to detection electronics the arrangement being characterised in that there are included;

a first transmit coil located below and aligned relative to a first line of a tennis court, and a second transmit coil located below and aligned relative to a second line of a tennis court which second line intersects with said first line, means to generate a first transmit signal having a first selected frequency being connected to said first transmit coil, and means to generate a second transmit signal having a second selected frequency being connected to said second transmit coil, a first receive coil located below and aligned relative to the said first transmit coil, and a second receive coil located below and aligned relative to the said second transmit coil, and detection electronic means connected to said first and second receive coils adapted to distinguish by reason of their frequency signals being received through said first and second transmit coils.

23. An arrangement for detection of location of a tennis ball relative to a court line as in claim 22 further characterised in that said first transmit coil includes means to selectively present a high impedance to an electromagnetic signal having said second selected frequency, and said second transmit coil includes means to selectively present a high impedance to an electromagnetic signal having said first selected frequency.

24. An arrangement for detection of location of a tennis ball relative to a court line as in claim 22 further characterised in that both said first frequency and said second frequency are each provided by a sinusoidal wave form.

25. An arrangement for detection of location of a tennis ball relative to a court line as in claim 22 further characterised in that said first selected frequency is a second harmonic of the said second frequency.

26. An arrangement for detection of location of a tennis ball relative to a court line as in claim 22 further characterised in that the said first transmit coil includes a filter means adapted to selectively present a high impedance to signals at said second selected frequency and second transmit coil includes a filter means adapted to selectively present a high impedance to signals at said first selected frequency.

27. An method for detection of location of a tennis ball relative to a court line of a type wherein transmit coils beneath and aligned with the line are adapted to transmit an alternating magnetic field and receiver coils are beneath and aligned with the line and adapted to and located so that any changes to a field resulting from a magnetically permeable tennis ball moving within the influence of the field are detectable by the receiver coil connected to detection electronics the method being characterised in that in relation to; a first transmit coil located below and aligned relative to a first line of a tennis court and a second transmit coil located below and aligned relative to a second line of a tennis court which second line intersects with said first line, there is generated a first transmit signal having a first selected frequency and supplied to said first transmit coil, and there is generated a second transmit signal having a second selected frequency which is different from the first said selected frequency and supplied to said second transmit coil, a first receive coil located below and aligned relative to the said first transmit coil, and a second receive coil located below and aligned relative to the said second transmit coil, and detection electronic means connected to said first and second receive coils distinguishing by reason of their frequency, signals being received from said first and second transmit coils.

28. A method for detection of location of a tennis ball relative to a court line as in claim 27 further characterised in that both said first frequency and said second frequency are each provided as a sinusoidal wave.

29. A method for detection of location of a tennis ball relative to a court line as in claim 27 further characterised in that said first selected frequency is a second harmonic of the said second frequency.

30. A method for detection of location of a tennis ball relative to a court line as in claim 27 further characterised in that the said first transmit coil includes a filter means adapted to selectively present a high impedance to signals at said second selected frequency and second transmit coil includes a filter means adapted to selectively present a high impedance to signals at said first selected frequency.

31. An arrangement for detection of the location of a magnetically permeable ball relative to a playing surface line including first transmit means adapted to create a first electromagnetic field or fields, second transmit means adapted to create a second electromagnetic field or fields which are distinguishable from the said first electromagnetic field or fields by reason of being of different frequency spectra and the first and second transmit means being each substantially uninfluenced by the field or fields created by the other, first receiving and second receiving means adapted to detect the first and the second electromagnetic fields respectively, and where both receiving means and both transmitting means include in each case at least one coil which is located beneath intersecting boundary lines of a tennis court and are adapted to and located so that perturbations to the first and second electromagnetic fields resulting from the ball moving within the influence of the fields produce a signal indicative of the location of the ball relative to the playing surface line.

* * * * *